United States Patent [19]

Merkle

[11] 4,043,154

[45] Aug. 23, 1977

[54] SPOOL RACK

[75] Inventor: Eberhard Merkle, Stuttgart, Germany

[73] Assignee: Wilh. Bleyle KG, Stuttgart, Germany

[21] Appl. No.: 678,677

[22] Filed: Apr. 20, 1976

[30] Foreign Application Priority Data

Aug. 7, 1974 Germany ..... 2438006

[51] Int. Cl.[2] ..... D04B 15/40

[52] U.S. Cl. ..... 66/125 R

[58] Field of Search ..... 66/125 R, 8

[56] References Cited

U.S. PATENT DOCUMENTS

| | | | |
|---|---|---|---|
| 3,168,969 | 1/1965 | Vossen | 66/125 R |
| 3,461,691 | 8/1969 | Ballard | 66/125 R |
| 3,589,146 | 6/1971 | Schmidt | 66/125 R |
| 3,805,556 | 4/1974 | Planck, Jr. | 66/125 R |

FOREIGN PATENT DOCUMENTS

| | | | |
|---|---|---|---|
| 2,051,591 | 10/1970 | Germany | 66/125 R |

*Primary Examiner*—Mervin Stein
*Assistant Examiner*—Andrew M. Falik
*Attorney, Agent, or Firm*—Edwin E. Greigg

[57] ABSTRACT

A spool frame adapted for transmission of thread to a circular knitting machine comprising a framework subdivided into open section areas with each open section area provided with superposed tiers of semi-circular supporting elements on which are rotatably supported spool carrier elements. Thread guide means are arranged above the topmost semi-circular tier of spool carriers to control feed of the thread to the knitting machine.

4 Claims, 4 Drawing Figures

*Fig.3*

SPOOL RACK

BACKGROUND OF THE INVENTION

The present invention relates to a spool frame intended for spools for a circular knitting machine or the like, wherein semi-circular supports, on which spool carriers are disposed, are arranged in a plurality of superposed tiers (planes) on a frame. Reference is also made herein to applicant's earlier application Ser. No. 597,148, filed July 18, 1975.

Spool frames of this type are already known. Typical examples are shown in the Austrian Pat. No. 261,094, German Pat. No. 248,647 and German Pat. No. 660,558.

OBJECT AND SUMMARY OF THE INVENTION

The object of the present invention is to produce a spool frame, which is capable of accommodating a maximum number of spools in a very simple manner in the minimum amount of space. The spools also should be readily accessible and mounted so that the threads cannot become entangled.

This is solved according to the invention in that a plurality of semi-circular supports are disposed adjacent to one another in superposed tiers.

This provides a spool frame having an extremely simple structure and requires very little space, even in the case of machines which simultaneously process up to 120 threads.

The frame according to the invention is constructed with extremely simple elements and units. It is possible to position the requisite number of spools to supply the knitting machine beneath the thread control device, which is, in turn, disposed beneath the upper edge of the circular knitting machine. As a result, it is possible to eliminate any special guide means or the like without running the risk of individual threads blocking the paths of other threads or of threads sticking to one another and becoming entangled, or even being mutually attracted because of electrostatic action, etc. The spool frame also can be so compact in its construction that it is not necessary to use ladders or the like, for the purpose of loading the frame.

Other objects, features and advantages of the present invention will be made apparent in the course of the following detailed description of a preferred embodiment thereof provided with reference to the accompanying drawings.

DESCRIPTION OF THE PREFERRED EMBODIMENT

Figure 1:
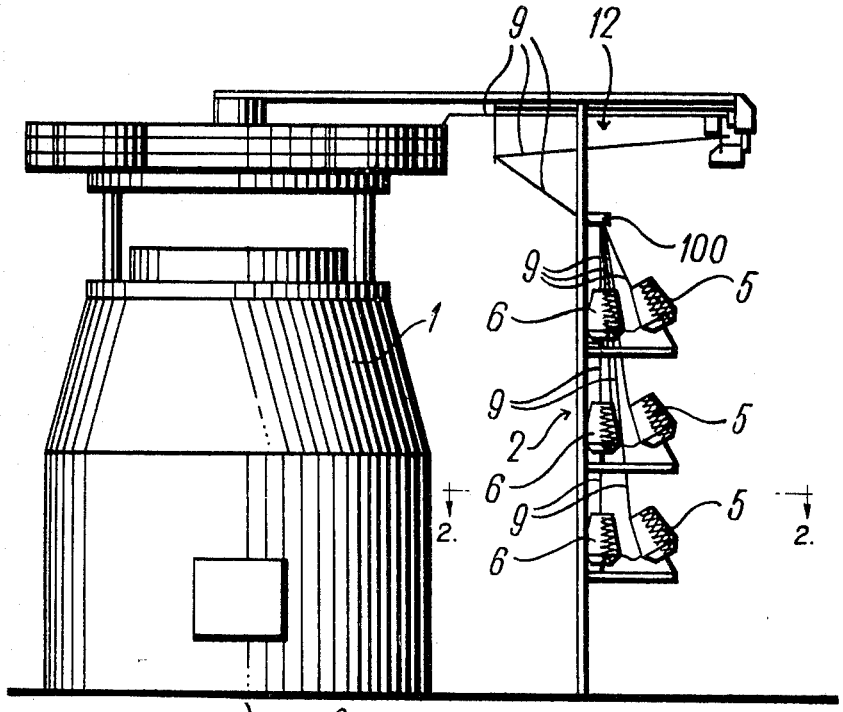
FIG. 1 is a diagrammatic side view of an embodiment of the invention.

Turning now to the drawings, FIG. 1 shows a circular knitting machine 1, comprising a spool frame 2, receiving the thread spools 5, 6, 7, 8, from which the thread 9 is removed and supplied to the circular knitting machine 1, by means of a thread guide 100 and a thread control device 12.

Figure 2:
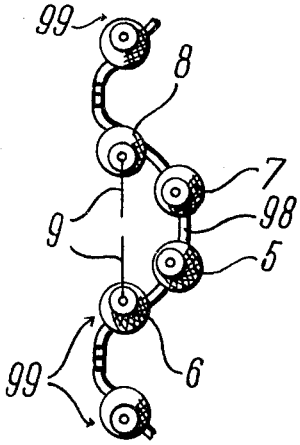
FIG. 2 shows a section along the line, II—II in FIG. 1.

The horizontally disposed, essentially semi-circular or curved supports 98, are welded to the vertically disposed struts of the frame sections 99 in a plurality of superposed tiers. As represented in FIG. 2, a plurality of these frame sections 99 are disposed adjacent to one another.

A plurality of short tubular elements 97, on the ends of which the spool carriers 92 are mounted, are disposed on the supports 98 at generally regular intervals and inclined towards the inside of the semi-circle forming the supports 98. The spool carriers 92 are used to hold spools 5, 6, 7, 8, from which threads 9 are removed. To insure that at least two spools are available for each thread 9, it is general practice to connect the end of the spool 8 to the beginning of the spool 7 and the end of the spool 6 to the beginning of the spool 5.

Figure 3:
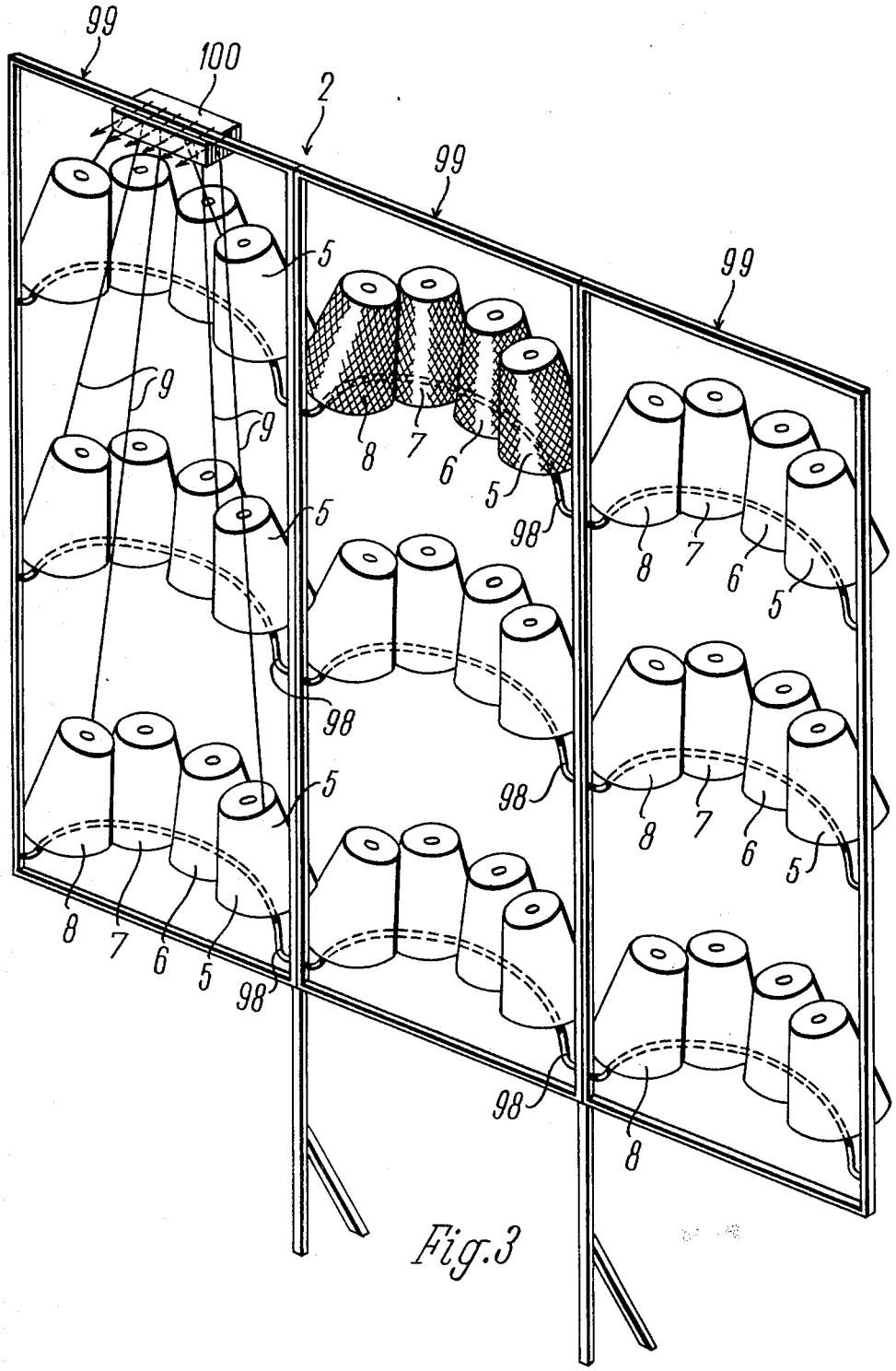
FIG. 3 is a perspective view of the embodiment shown in FIGS. 1 and 2.

The tubular elements 97 and the carriers 92 supported thereon, are inclined towards the inside of the semi-circle formed by the supports 98 so that their extensions intersect approximately at the point at which the thread guide 100 is disposed, all of which is clearly shown in FIGS. 1 and 3. Accordingly, the point of intersection lies above the topmost support 98, and inside the semi-circle formed by said support. All of the threads 9 are passed through the thread guide 100 from where they then pass to the circular knitting machine 1.

A single circular knitting machine of this type generally simultaneously works 48 threads and in special instances up to 120 threads. The represented spool arrangement makes it possible to accommodate a large number of spools in a small space. In such a construction, all of the spools are accessible from both sides, and owing to the fact that two spools are provided for one thread (for example, spools 5 and 6, or 7 and 8), it is very simple to interchange the individual spools during operation. Apart from the single thread guide 100, through which all of the threads 9 are passed, this spool frame does not require any other special mechanical guide for the individual threads in order to prevent the threads from becoming entangled. All the threads are so guided that they do not obstruct one another.

Figure 4:
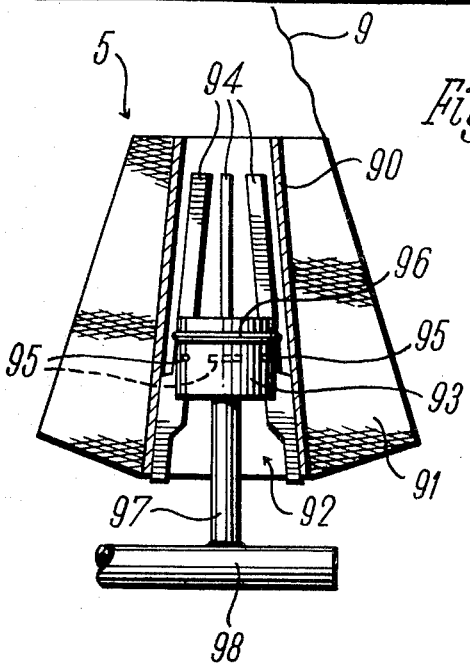
FIG. 4 is a cross-sectional view of a spool carrier.

FIG. 4 shows an enlarged cross-sectional view of the structure of the spool carrier 92. A plurality of arms are pivotally supported on pins 95 on the cylindrical part 93. Above the aforementioned rotary connection the arms 94 are held together by an elastic band 96, which presses the parts of the arms 94 situated above the pins 95 together thereby urging apart the portions of the arms 94 disposed below the pins 95. As a result, these portions are urged outwards against the spools 90, on which the thread 9 is wound. In this way, spools having different inner cross-sections can be mounted without difficulty on the spool carrier 92 and readily removed therefrom. The part 93 is welded to the above-mentioned short tubular section 97.

What is claimed is:

1. A spool frame for wound spools for transmission of thread to circular knitting machines comprising, an upstanding framework generally confined to a single plane subdivided into separated open section areas, each said open section area including a plurality of superposed semi-circular supporting elements the ends of which are finedly attached to said frame, a thread guide associated with the top thereof, and said semi-circular supporting elements provided with spool carrier means, each said spool carrier means being inclined inwardly of said semi-circular supporting elements and directed toward the thread guide means associated with the top of said section area and said thread guide means disposed substantially medially of said semi-circular supporting elements.

2. A spool frame as claimed in claim 1, in which said spool carriers include slotted rotatable support elements to which a plurality of arm members are pivotally attached.

3. A spool frame as claimed in claim 2, in which elastic means are associated with said pivotal arm members.

4. A spool frame as claimed in claim 3, in which said elastic means is affixed to said rotatable support elements in a plane above the point of pivotal attachment of said arms to said rotatable support elements.

* * * * *